United States Patent [19]

Vaughan

[11] 3,973,866

[45] Aug. 10, 1976

[54] CENTRIFUGAL CHOPPING SLURRY PUMP

[75] Inventor: James E. Vaughan, Elma, Wash.

[73] Assignee: Vaughan Co., Inc., Montesano, Wash.

[22] Filed: Jan. 2, 1975

[21] Appl. No.: 538,169

[52] U.S. Cl. ..... 415/121 B; 415/143; 241/46.11

[51] Int. Cl.[2] ..... F04D 1/04; F04D 7/04

[58] Field of Search ..... 416/228, 235, 242, 243, 416/181, 182; 241/46.11, 46.17, 46.08; 415/121 B, 213 R, 143, 109, 21 BR

[56] References Cited

UNITED STATES PATENTS

| | | | |
|---|---|---|---|
| 1,149,904 | 8/1915 | Foster | 415/213 R |
| 1,867,809 | 7/1932 | Chase | 416/242 |
| 2,134,921 | 11/1938 | Kelleweay | 416/235 |
| 2,496,359 | 2/1950 | Rymann | 415/121 B |
| 3,124,200 | 3/1964 | Wilson | 416/181 |
| 3,155,046 | 11/1964 | Vaughan | 415/121 B |
| 3,163,405 | 12/1964 | Balassa | 415/143 |
| 3,246,605 | 4/1966 | Fisher | 415/213 R |
| 3,325,107 | 6/1967 | Peterson | 415/121 B |
| 3,444,818 | 5/1969 | Sutton | 415/121 B |
| 3,535,051 | 10/1970 | Turner | 415/109 |
| 3,644,055 | 2/1972 | Davis | 415/DIG. 1 |

FOREIGN PATENTS OR APPLICATIONS

| | | | |
|---|---|---|---|
| 699,042 | 12/1965 | Italy | 241/46.17 |
| 8,825 | 1891 | United Kingdom | 416/235 |

*Primary Examiner*—Henry F. Raduazo
*Attorney, Agent, or Firm*—Robert W. Beach

[57] ABSTRACT

Radial runner blades projecting axially from a shroud plate have leading faces inclined from the axial central portions of the blades forward to a cutting edge adjacent to an intake casing wall at an angle of 45°. The trailing wall of each blade is bent to form a reflex angle at approximately its axial central portion, and each blade flares in cross-sectional thickness from its axial central portion toward its edge adjacent to the intake wall. A screw propeller connected to the runner and located at the side of the intake wall opposite the runner facilitates flow of material to the pump toward the casing intake ports, slices sliceable articles into pieces of a size for passage through the intake ports and displaces unsliceable objects for clearing the intake ports.

5 Claims, 7 Drawing Figures

Fig. 2.
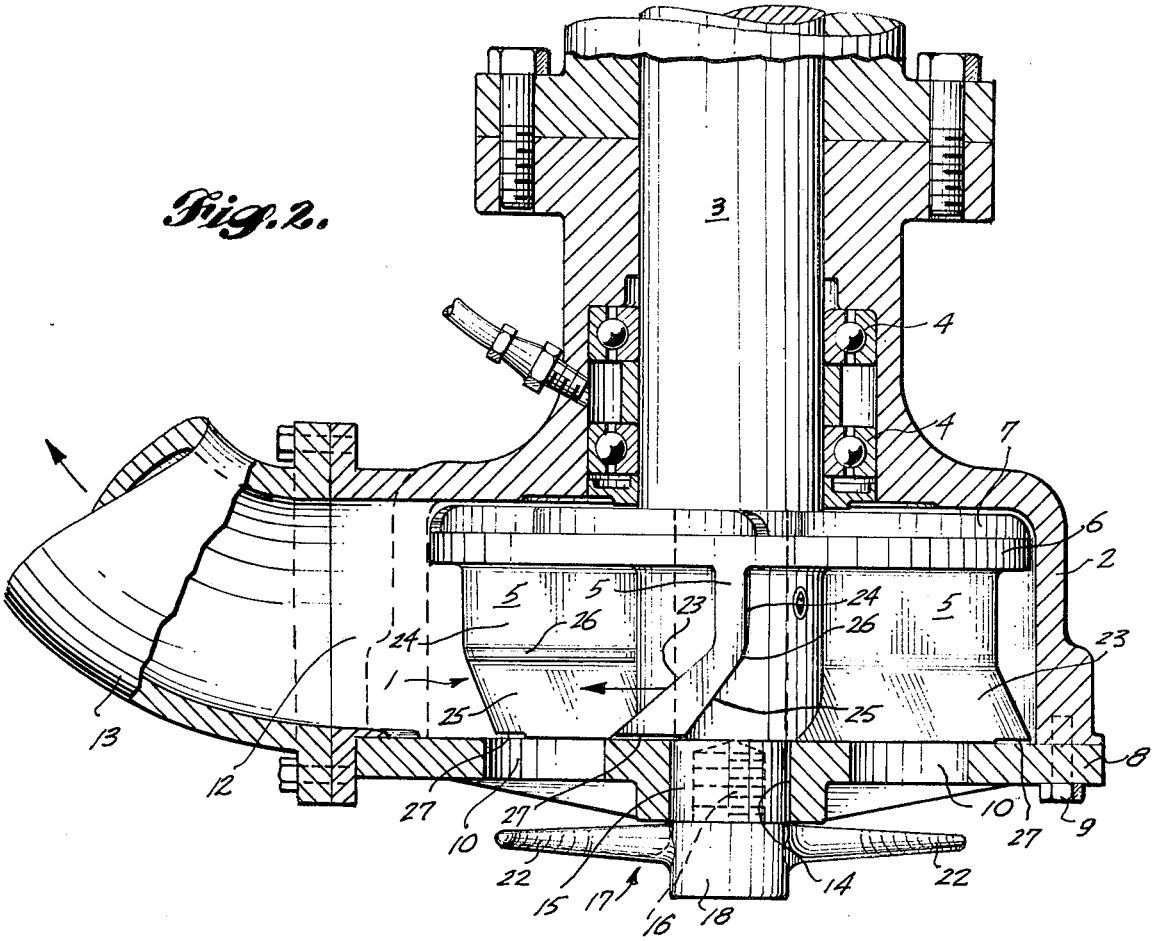
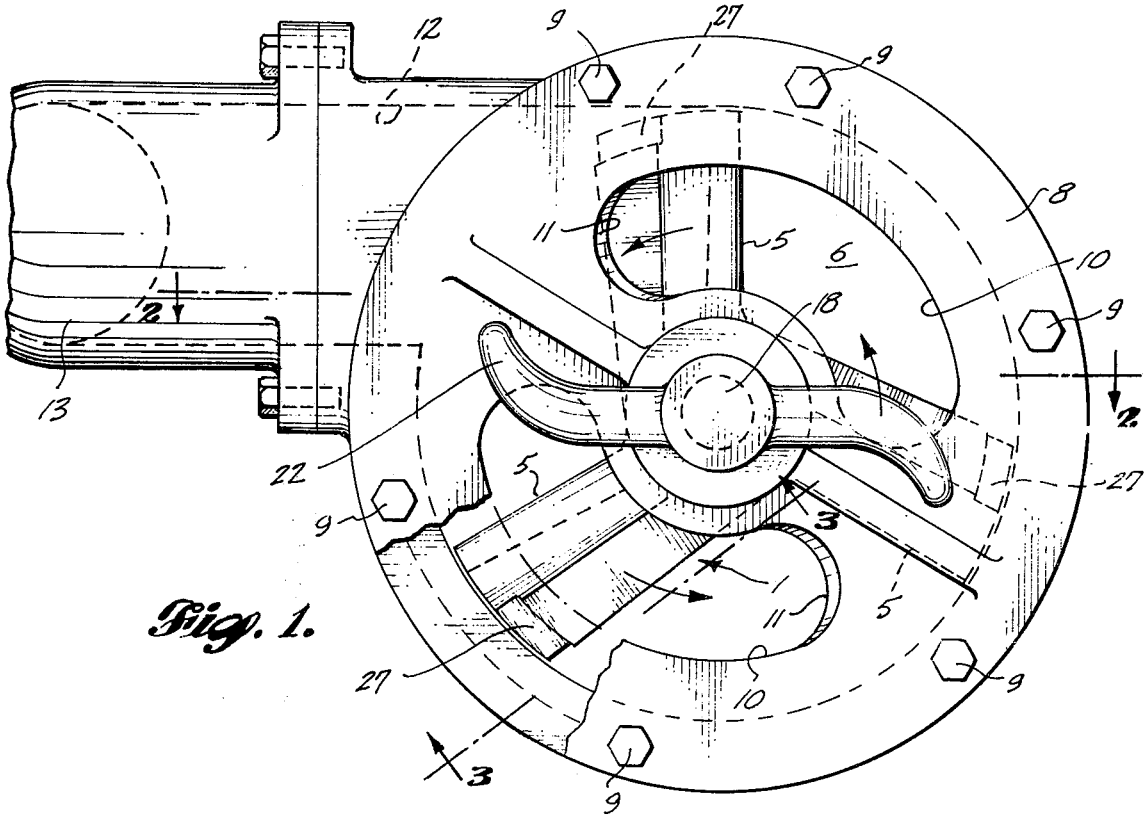
Fig. 1.

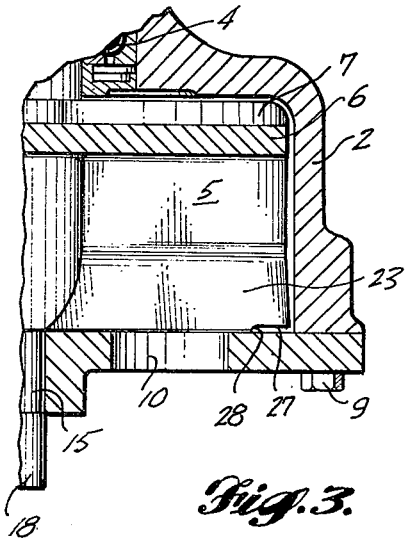
Fig. 3.
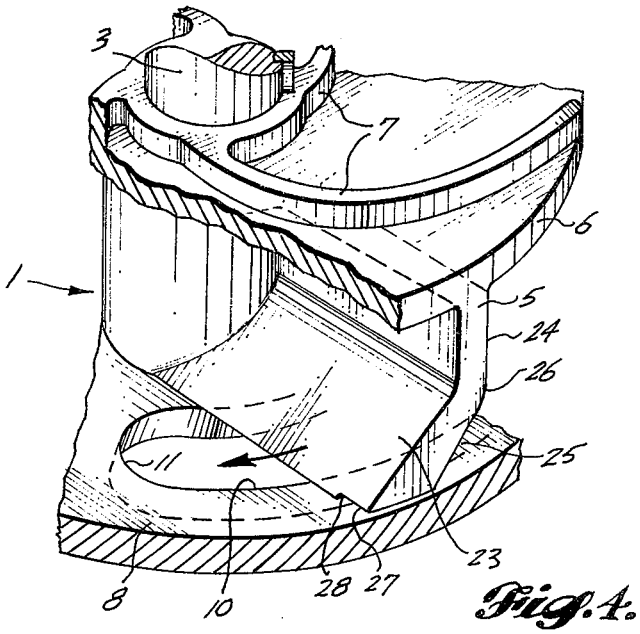
Fig. 4.
Fig. 5.
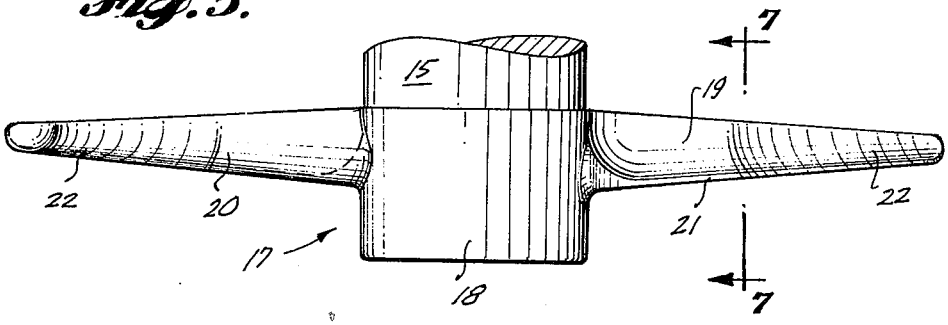
Fig. 6.
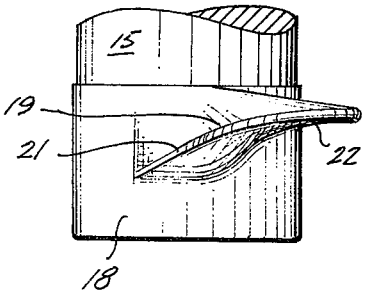
Fig. 7.
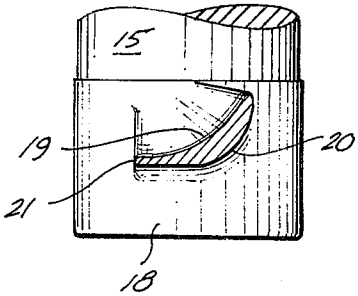

CENTRIFUGAL CHOPPING SLURRY PUMP

BACKGROUND OF THE INVENTION

1. Field of the Invention

This invention relates to centrifugal pumps and more particularly to such pumps effective for pumping slurry and which can chop stringy material, slice reasonably soft material such as vegetables and displace hard objects tending to obstruct flow into the pump intake opening of material to be pumped.

A difficult problem has been to pump slurries consistently and effectively. A slurry is a watery mixture or suspension of insoluble matter and may be of different consistency from a solid-material-to-water ratio of about 5 percent to about 25 percent. The term "slurry" is generic for different types of watery mixtures or suspensions of insoluble matter including mud which is a mixture of earth and water and pulp which is a mixture of animal or vegetable matter and water or other liquid. The pulp may be pulp of fruit such as apples, pears, peaches or plums for example, vegetables such as carrots or peas, other food products such as sugar cane, or wood such as used in the manufacture of paper. Pulp may also be a mixture of pulverized ore or white lead and water. All of these slurries are difficult to pump with pumps of conventional type. The pump of the present invention is capable of pumping such slurries satisfactorily.

2. Prior Art

The pump constitutes an improvement on the general type of pumps disclosed in U.S. Pat. No. 3,155,046, particularly as to effectiveness for pumping slurry. Also, the runners of pumps of the general type of U.S. Pat. No. 3,155,046 have included a shroud plate at the side of the runner opposite the intake wall of the pump casing, and such shroud plate has included a volute slinger serving to deter migration of the solid phase of a slurry into bearings of the runner shaft. In addition, rotary stirrers have been carried by the runner shaft at the side of the intake wall opposite the runner for the purpose of displacing articles which would not pass readily through an intake opening into the pump casing.

SUMMARY OF THE INVENTION

A principal object of this invention is to increase the capacity of a centrifugal pump to pump thick slurry without the pump clogging or losing its prime and without the slurry being dewatered. More specifically, it is an object to increase the pump capacity by utilizing a booster propeller exteriorly of the pump casing to facilitate inflow of material to be pumped through the intake openings of the casing and by improving the configuration of the runner blades to facilitate suction of material through the intake openings of the casing.

Another object is to enable a centrifugal pump to pump material containing objects which can be sliced comparatively easily into pieces capable of passing through the intake openings of the pump casing.

It is also an object to increase the efficiency of a centrifugal pump for pumping slurry by reducing resistance of the runner to rotation.

The foregoing objects can be accomplished by providing a booster propeller exteriorly of the pump casing which will facilitate flow toward the intake openings of the casing of material to be pumped and which will slice readily sliceable articles into pieces that can pass through the intake openings of the casing and by forming the leading face of each runner blade with a forwardly inclined portion to increase the pumping effectiveness of the blades.

BRIEF DESCRIPTION OF THE DRAWINGS

FIG. 1 is a bottom plan of the intake side of a pump according to the present invention, and FIG. 2 is a section taken on line 2—2 of FIG. 1.

FIG. 3 is a fragmentary section through a portion of the pump taken on line 3—3 of FIG. 1, and FIG. 4 is a top perspective of the same portion of the pump.

FIG. 5 is an edge elevation of the booster propeller;

FIG. 6 is an end elevation of the booster propeller seen from line 6—6 of FIG. 5, and FIG. 7 is a section through a propeller blade taken on line 7—7 of FIG. 5.

DETAILED DESCRIPTION

Like the pump disclosed in U.S. Pat. No. 3,155,046, the pump includes a runner 1 received in the cavity of a casing 2 in which it is supported for rotation by a shaft 3. Such shaft is mounted for rotation relative to the casing 2 by antifriction bearings 4 supporting the runner in cantilever fashion. The runner has several circumferentially spaced generally radial blades 5, three such blades being shown for purposes of illustration. One radial edge of each blade is shown as being formed integral with one side of a shroud plate 6. The opposite side of such shroud plate carries several volute ribs 7 forming a slinger for slinging away from the bearing structure 4 the solid material component of slurry which may work its way past the edge of shroud plate 6, so as to reduce wear of such bearing structure.

The cavity of casing 2 in which the runner 1 is housed has only one side open to receive such runner, and that opening is closed by a cover plate 8 secured to the casing by circumferentially spaced cap screws 9. Such cover plate constitutes the intake wall of the casing and has in it at least one intake port 10 through which material to be pumped can enter the cavity of casing 2. As shown best in FIG. 1, the intake ports 10 are arcuate slots offset radially from the axis of runner 1 and arranged concentrically with such axis. The end 11 of each arcuate intake slot toward which the runner blades move has a sharpened inner edge for cooperation with the runner blade edges to chop stringy material entering the casing through the intake ports.

Material entering the casing 2 through the intake ports 10 is discharged through the tangential discharge port 12 and discharge pipe 13 connected to such port. Such discharge port is of substantially square or rectangular cross section, in order to provide maximum area for discharge of material from the pump casing, and discharge pipe 13 may include a transition section connecting the discharge port 12 of square or rectangular cross section with a portion of pipe 13 of circular cross section.

A hole 14 extending through the central portion of the cover plate 8 coaxial with shaft 3 receives the tip 15 of shaft 3 which shaft carries the runner 1. While such shaft tip may have bearing engagement with the wall of hole 14, it is preferred that the shaft tip simply be located concentrically of such hole and that there be clearance between the shaft tip and the hole. The shaft tip 15 has a blind bore internally to receive an externally, complementally threaded stem 16. Such stem projects upward from a booster screw propeller 17.

The screw propeller 17 includes a hub 18 integral with the stem 16 and mounted by such stem in axial continuation of the shaft tip 15. A plurality of propeller blades of cambered cross section project generally radially from the hub 18. Two of such blades are shown in FIGS. 1, 2 and 5. These blades have concave sides 19 and convex sides 20 and have pitch so as to produce a current toward the intake ports 10. Consequently, the propeller serves as a booster for the pumping action of the runner 1. The leading edge 21 of each blade is quite sharp so that such edge will slice relatively soft material such as fruit or vegetables into pieces of a size which can pass through the intake ports 10.

In some types of installation, chunks of hard material may be encountered which are too large to pass through the intake openings 10 and too hard to be sliced by the sharp leading edges 21 of the propeller blades. To clear the intake ports 10 of such chunks, the tip portions 22 of the propeller blades are swept back abruptly relative to the remainder of the blade. When a propeller blade leading edge strikes such a chunk the chunk will be displaced radially outward from the current of material flowing to and through the intake ports 10 of the pump casing by centrifugal force aided by wedging force of the swept back blade tip portion. The general cross section contour of the propeller blades can be continued into such swept back tip portions, however, so that they will function effectively to propel slurry toward the intake ports.

While, as explained above, the screw propeller 17 produces a current of slurry toward the intake ports 10, the runner 1 at the side of the intake wall opposite the propeller will produce a suction drawing such material through the intake ports as the runner rotates. Such suction action is increased by forming the runner blades, as illustrated best in FIGS. 2, 3 and 4. The portion of the runner blade adjacent to the casing intake wall is inclined forwardly from approximately the axial center of the blade. The angle of the inclined portion of the leading side 23 of the runner blade is approximately 45° relative to the flat cutting edge of the blade and to a plane perpendicular to the axis of rotation or to the axis of rotation.

The trailing side of each runner blade is bent at 26 to form a reflex angle between a portion 24 adjacent to the shroud plate 6 and a portion 25 adjacent to the intake wall. While such bend can be angular, it preferably is convexly curved. The reflex angle is approximately 220 degrees. By such contruction, the leading side and the trailing side of each runner blade flares from approximately the axially central portion of the blade to its edge having a cutting edge adjacent to the intake wall of the casing, as shown best in FIG. 2, to provide a wide wear edge on the blade while forming a streamlined blade for maximum pumping effectiveness.

In order to reduce drag or resistance to rotation of the runner caused by material thrown to the periphery of the casing cavity by centrifugal force, it is preferred that the outer end portion of each runner blade edge adjacent to the intake wall have adequate clearance. For this purpose step 27, preferably forming a shoulder 28, as shown best in FIGS. 3 and 4, increases the clearance between the outer end portion of the runner blade edge and the intake wall near the circumference of the cavity in casing 2. It is preferred, however, that there be only very small clearance between the radially inner and radially outer margins of the intake ports 10 and the adjacent edges of the runner blades. The clearance between the stepped portions 27 of the blade edges and the intake wall will be substantially greater than the clearance between the margins of the intake ports and the adjacent edges of the runner blades.

Rotation of shaft 3 relative to casing 2 will rotate the runner 1 and the propeller 17 in synchronism. Rotation of the propeller will produce a current pushing slurry toward the intake openings 10 without dewatering it. Coincidentally, the sharp leading edge of the propeller will slice soft material into pieces which can pass through the intake ports. Simultaneously, rotation of the runner blades will produce a suction at the side of the intake ports opposite the propeller, which also acts to induce flow of slurry through the intake ports. The combined pushing action of the propeller 17 and suction action of the blades of runner 1 on the slurry material produces a strong flow of slurry through the intake ports 10 into the casing 2 and out through the discharge port 12 even though the slurry is rather thick, such as being as much as 25 percent solid material by weight, although the pump operates most effectively for pumping slurry in which the solid material is 10 percent to 20 percent by weight.

I claim:

1. A centrifugal chopping slurry pump, comprising a runner having a runner blade with a substantially radial cutting edge, a casing housing said runner and having an intake wall with an intake port spaced radially from the axis of said runner and traversed by said substantially radial cutting edge of said runner blade in cutting relationship to an edge of said intake port, and a screw propeller connected to said runner for rotation about the runner axis, located at the side of said casing intake wall opposite said runner and spaced from said casing intake wall, the leading edge of the tip portion of each screw propeller blade being sharp to slice and reduce the size of material for passage through said intake port and said tip portion being swept back abruptly relative to the remainder of the blade for displacing away from said intake port objects not reduced in size sufficiently as to be capable of passing through said intake port, and the blades of said screw propeller having a pitch for producing a booster current toward said intake port to assist in feeding material toward and through said intake port to said runner blade having its cutting edge in cutting relationship to said intake port.

2. In the pump defined in claim 1, the runner blade briding substantially radially across the intake port and the radially outer end portion of the runner blade edge portion adjacent to the intake wall and radially outwardly of the intake port being stepped to provide clearance between such blade edge portion and the intake wall greater than the clearance betwen the cutting edge of the runner blade and a margin of the intake port.

3. In the pump defined in claim 1, the front wall of the runner blade being forwardly inclined in the direction of runner rotation from approximately the axial center of the blade to the edge of said marginal portion.

4. A centrifugal chopping slurry pump comprising a runner, and a casing housing said runner and having an intake wall with a circumferentially elongated intake port spaced radially from the axis of said runner, said runner including a substantially radial runner blade having a flat edge portion normal to the runner axis and forming a cutting edge disposed in adjacent cutting relationship to an edge of said intake port and extending entirely across said intake port, said runner blade having a front surface inclined substantially uniformly from approximately the axial center of said runner blade forward in the direction of runner rotation to said cutting edge at an angle of approximately 45 degrees relative to said flat edge portion of said blade, and said runner blade being flared in cross-sectional thickness from the axially central portion of said runner blade toward said flat edge portion.

5. In the pump defined in claim 4, the radially outer end portion of the runner blade edge portion adjacent to the intake wall and radially outwardly of the intake port being stepped to provide clearance between such blade edge portion and the intake wall greater than the clearance between the cutting edge of the runner blade and a margin of the intake port.

* * * * *